US010720119B2

(12) United States Patent
Tashiro

(10) Patent No.: US 10,720,119 B2
(45) Date of Patent: Jul. 21, 2020

(54) DRIVE DEVICE AND LIQUID CRYSTAL DISPLAY APPARATUS

(71) Applicant: Mitsubishi Electric Corporation, Tokyo (JP)

(72) Inventor: Tomohiro Tashiro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 64 days.

(21) Appl. No.: 15/397,823

(22) Filed: Jan. 4, 2017

(65) Prior Publication Data

US 2017/0213518 A1 Jul. 27, 2017

(30) Foreign Application Priority Data

Jan. 27, 2016 (JP) ..... 2016-013309

(51) Int. Cl.
*G09G 3/36* (2006.01)

(52) U.S. Cl.
CPC ..... *G09G 3/3688* (2013.01); *G09G 3/3648* (2013.01); *G09G 2310/0291* (2013.01);
(Continued)

(58) Field of Classification Search
CPC ..... G09G 3/3688; G09G 3/3648; G09G 2330/025; G09G 2330/12; G09G 2320/0693; G09G 2310/0291
See application file for complete search history.

(56) References Cited

U.S. PATENT DOCUMENTS 5,047,751 A * 9/1991 Miura ..... G01R 19/16538 327/82
5,136,186 A * 8/1992 Trinh ..... H03K 19/00361 326/31
(Continued)

FOREIGN PATENT DOCUMENTS

CN 101192378 A 6/2008
CN 101211551 A 7/2008
(Continued)

OTHER PUBLICATIONS

An Office Action mailed by the State Intellectual Property Office of the People's Republic of China dated Dec. 5, 2018, which corresponds to Chinese Patent Application No. 201710063288.0 and is related to U.S. Appl. No. 15/397,823; with English translation.
(Continued)

*Primary Examiner* — Grant Sitta
(74) *Attorney, Agent, or Firm* — Studebaker & Brackett PC

(57) ABSTRACT

A drive device according to the present invention is located in a liquid crystal panel. The drive device is a source driver IC that drives a pixel region of the liquid crystal panel. The drive device includes a comparison circuit and a determination circuit. The comparison circuit detects a potential difference between a potential of a first analog power supply and a potential of a second analog power supply, an analog power supply input from the outside being divided into the first analog power supply and the second analog power supply. The determination circuit determines that it is an abnormal condition when the potential difference detected by the comparison circuit is greater than or equal to a predetermined threshold value.

7 Claims, 17 Drawing Sheets

(52) U.S. Cl.
CPC ..... *G09G 2320/0693* (2013.01); *G09G 2330/025* (2013.01); *G09G 2330/12* (2013.01)

(56) References Cited

U.S. PATENT DOCUMENTS 5,481,194 A * 1/1996 Schantz ..... B60L 1/003 324/509
5,861,771 A * 1/1999 Matsuda ..... H02M 3/1563 327/540
5,886,565 A * 3/1999 Yasui ..... G05F 1/575 327/530
6,085,342 A * 7/2000 Marholev ..... G06F 11/1441 327/143
6,118,295 A * 9/2000 Murayama ..... G06F 1/28 324/433
6,147,521 A * 11/2000 Degoirat ..... G01R 19/16519 327/206
6,492,849 B2 * 12/2002 Ikoma ..... G11C 5/14 327/143
6,642,706 B2 * 11/2003 Shen ..... H05B 41/2855 324/120
6,690,149 B2 2/2004 Monomoushi et al.
6,751,079 B2 * 6/2004 Bretschneider .. G01R 19/16538 361/90
6,809,576 B1 * 10/2004 Yamasaki ..... G05F 1/465 327/540
7,119,529 B2 * 10/2006 Kadner ..... G05F 1/46 323/367
7,579,904 B2 * 8/2009 Im ..... G11C 5/14 327/540
7,589,568 B2 * 9/2009 Steedman ..... G01R 19/16552 327/143
7,683,591 B2 * 3/2010 Sadayuki ..... G05F 1/575 323/272
7,812,807 B2 10/2010 Yano et al.
7,928,776 B2 * 4/2011 Wang ..... G06F 1/26 327/143
8,044,708 B2 * 10/2011 Kume ..... G05F 3/16 327/143
8,653,865 B2 * 2/2014 Utsuno ..... G06F 1/28 327/143
9,230,490 B2 * 1/2016 Hu ..... G09G 3/3426
9,871,390 B2 * 1/2018 Wu ..... H02J 7/0031
9,941,670 B2 * 4/2018 Tanaya ..... H01T 19/00
2001/0013850 A1 * 8/2001 Sakaguchi ..... G09G 3/3611 345/87
2002/0014637 A1 * 2/2002 Higuchi ..... G11C 5/143 257/200
2003/0226082 A1 * 12/2003 Kim ..... G06K 19/073 714/734
2004/0021627 A1 2/2004 Maki
2005/0156863 A1 * 7/2005 Kim ..... G09G 3/3685 345/100
2006/0071882 A1 * 4/2006 Sempel ..... G09G 3/3216 345/76
2008/0158216 A1 7/2008 Kuroda
2009/0146738 A1 * 6/2009 Chang ..... H03F 1/086 330/255
2010/0033472 A1 * 2/2010 Choi ..... G09G 3/3688 345/213
2010/0164619 A1 * 7/2010 Kim ..... H03F 1/523 330/124 R
2010/0225635 A1 * 9/2010 Murahashi ..... G09G 3/006 345/213
2011/0032240 A1 2/2011 Wang et al.
2011/0043114 A1 * 2/2011 Hsu ..... H05B 33/0815 315/119
2011/0084761 A1 * 4/2011 Wang ..... H03F 3/3013 330/124 R
2011/0199366 A1 8/2011 Tsuchi
2011/0205193 A1 * 8/2011 Nishimura ..... H03F 3/3023 345/204
2011/0261492 A1 * 10/2011 Lu ..... H02M 1/32 361/79
2012/0038614 A1 * 2/2012 Mizumaki ..... G09G 3/3614 345/211
2012/0050249 A1 * 3/2012 Jin ..... G09G 3/20 345/212
2012/0056857 A1 * 3/2012 Li ..... G09G 3/20 345/204
2012/0127213 A1 * 5/2012 Park ..... G09G 3/006 345/690
2012/0146976 A1 * 6/2012 Lee ..... G09G 3/3688 345/211
2012/0293562 A1 * 11/2012 Park ..... G09G 3/3233 345/690
2013/0016086 A1 * 1/2013 Ebisuno ..... G09G 3/3225 345/212
2013/0016310 A1 * 1/2013 Kanemitsu ..... G08B 5/36 349/69
2014/0028658 A1 1/2014 Nakata et al.
2014/0084792 A1 * 3/2014 Oh ..... H05B 47/10 315/120
2014/0111498 A1 * 4/2014 Kim ..... G09G 3/3291 345/212
2014/0223085 A1 * 8/2014 Jo ..... G11C 16/225 711/103
2014/0313182 A1 10/2014 Xie
2015/0054584 A1 * 2/2015 Chang ..... H03M 1/66 330/291
2015/0187335 A1 * 7/2015 Sugiyama ..... G09G 3/32 345/208
2016/0050732 A1 * 2/2016 Lin ..... H05B 33/089 315/121
2016/0267833 A1 * 9/2016 Lee ..... H05B 33/0803
2016/0349304 A1 * 12/2016 Sartori ..... G01R 31/025
2017/0245379 A1 * 8/2017 Kang ..... G01R 31/025

FOREIGN PATENT DOCUMENTS

CN 101996552 A 3/2011
CN 102103844 A 6/2011
CN 102163399 A 8/2011
CN 102479479 A 5/2012
CN 103280847 A 9/2013
JP 05-041651 A 2/1993
JP 2000-172231 A 6/2000
JP 2001-255857 A 9/2001
JP 2003-084723 A 3/2003
JP 2004-021163 A 1/2004
JP 2004-354518 A 12/2004
JP 2005-208551 A 8/2005
WO 2010/095348 A1 8/2010
WO 2012/137886 A1 10/2012

OTHER PUBLICATIONS

An Office Action mailed by the Japanese Patent Office dated Nov. 26, 2019, which corresponds to Japanese Patent Application No. 2016-013309 and is related to U.S. Appl. No. 15/397,823; with English language translation.

An Office Action mailed by the State Intellectual Property Office of People's Republic of China dated Aug. 21, 2019, which corresponds to Chinese Patent Application No. 201710063288.0 and is related to U.S. Appl. No. 15/397,823.

* cited by examiner

FIG. 10

| HORIZONTAL RESOLUTION | 800 | 800 | 960 | 960 | 960 | 1280 | 1280 | 1920 | 1920 |
|---|---|---|---|---|---|---|---|---|---|
| NUMBER OF OUTPUTS OF RGB | 2400 | 2400 | 2880 | 2880 | 2880 | 3840 | 3840 | 5760 | 5760 |
| NUMBER OF OUTPUTS OF S-ICs | 800 | 1200 | 800 | 960 | 1440 | 960 | 1284 | 1440 | 1920 |
| NUMBER OF S-ICs | 3 | 2 | 4 | 3 | 2 | 4 | 3 | 4 | 3 |

DRIVE DEVICE AND LIQUID CRYSTAL DISPLAY APPARATUS

BACKGROUND OF THE INVENTION

Field of the Invention

The present invention relates to a drive device that drives a pixel region of a liquid crystal panel and to a liquid crystal display apparatus that includes the drive device.

Description of the Background Art

The use of the same part in liquid crystal display apparatuses of different sizes has led to a reduced cost (a unit cost of the part) by increased purchases of the same part or to "platform" for reducing a period of development and design resources. The same common part has been used in various kinds of liquid crystal panels.

A high-resolution and large liquid crystal display apparatus typically tends to cause a heavy load connected to an output stage of a driver integrated circuit (IC) that drives a liquid crystal panel. The driver IC includes a circuit capable of driving a liquid crystal panel even under heavy load conditions. In one example, some driver ICs capable of driving a liquid crystal panel under heavy load conditions include an assist circuit (auxiliary circuit) that assists (supports) an output from an output amplifier for cases where sufficient output cannot be obtained only by driving capability of the output amplifier.

Some applications of a liquid crystal display require low power consumption, and many attempts have been made to minimize a load on a liquid crystal panel. Some liquid crystal panels have a structure having a reduced capacity or a reduced resistance of source lines (for example, see Japanese Patent Application Laid-Open No. 5-41651 (1993) and Japanese Patent Application Laid-Open No. 2001-255857). In consideration of the platform and the drive of various kinds of liquid crystal panels under load conditions, the driver IC capable of driving a liquid crystal panel under heavy load conditions is eventually used to drive a liquid crystal panel under low load conditions in some cases.

The conventional assist circuit has no problem in operating under originally assumed heavy load conditions, but may generate a flow-through current at a low load depending on conditions. An increase in the flow-through current does not affect a display. Thus, whether the flow-through current is generated cannot be easily monitored according to product conditions, thereby making it difficult to determine whether the liquid crystal panel is under abnormal conditions.

SUMMARY OF THE INVENTION

It is an object of the present invention to provide a drive device capable of suppressing a flow-through current generated in an assist circuit and provide a liquid crystal display apparatus that includes the drive device.

A drive device is located in a liquid crystal panel and drives a pixel region of the liquid crystal panel. The drive device includes a comparison circuit and a determination circuit. The comparison circuit detects a potential difference between a potential of a first analog power supply and a potential of a second analog power supply, an analog power supply input from the outside being divided into the first analog power supply and the second analog power supply. The determination circuit determines that it is an abnormal condition when the potential difference detected by the comparison circuit is greater than or equal to a predetermined threshold value, According to the present invention, the drive device is located in the liquid crystal panel and drives the pixel region of the liquid crystal panel. The drive device includes the comparison circuit and the determination circuit. The comparison circuit detects the potential difference between the potential of the first analog power supply and the potential of the second analog power supply, the analog power supply input from the outside being divided into the first analog power supply and the second analog power supply. The determination circuit determines it is the abnormal condition when the potential difference detected by the comparison circuit is greater than or equal to the predetermined threshold value. Thus, the drive device can suppress the flow-through current generated in the assist circuit.

These and other objects, features, aspects and advantages of the present invention will become more apparent from the following detailed description of the present invention when taken in conjunction with the accompanying drawings.

BRIEF DESCRIPTION OF THE DRAWINGS

FIG. 10 shows an example of a relationship among a horizontal resolution, the number of outputs of source driver ICs, and the number of use of the source driver ICs;

DESCRIPTION OF THE PREFERRED EMBODIMENTS

Preferred embodiments according to the present invention will be described below with reference to the drawings.

<Underlying Technology>

To reduce costs of liquid crystal display apparatuses, the increased number of output channels of driver ICs has been encouraging the reduced number of use of the driver ICs (see FIG. 10). FIG. 10 shows an example of a relationship among a horizontal resolution, the number of outputs of source driver ICs, and the number of use of the source driver ICs. A terminal pitch located on a side bonded to a liquid crystal panel cannot be easily reduced in size by a tape carrier package (TCP) technology or a Chip-on-Film (COF) technology, resulting in the increasing use of a Chip-on-Glass (COG) technology especially for liquid crystal display apparatuses of small and medium sizes.

Figure 11:
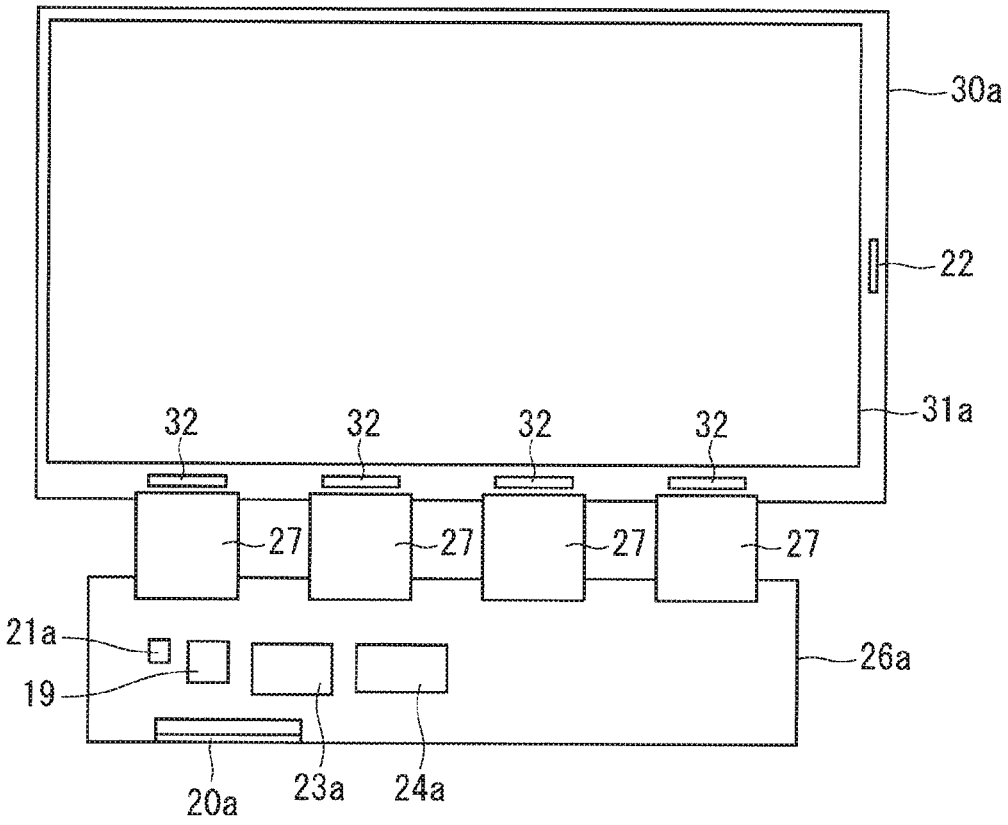
FIG. 11 shows an example of a configuration of a typical liquid crystal display apparatus.
Figure 12:
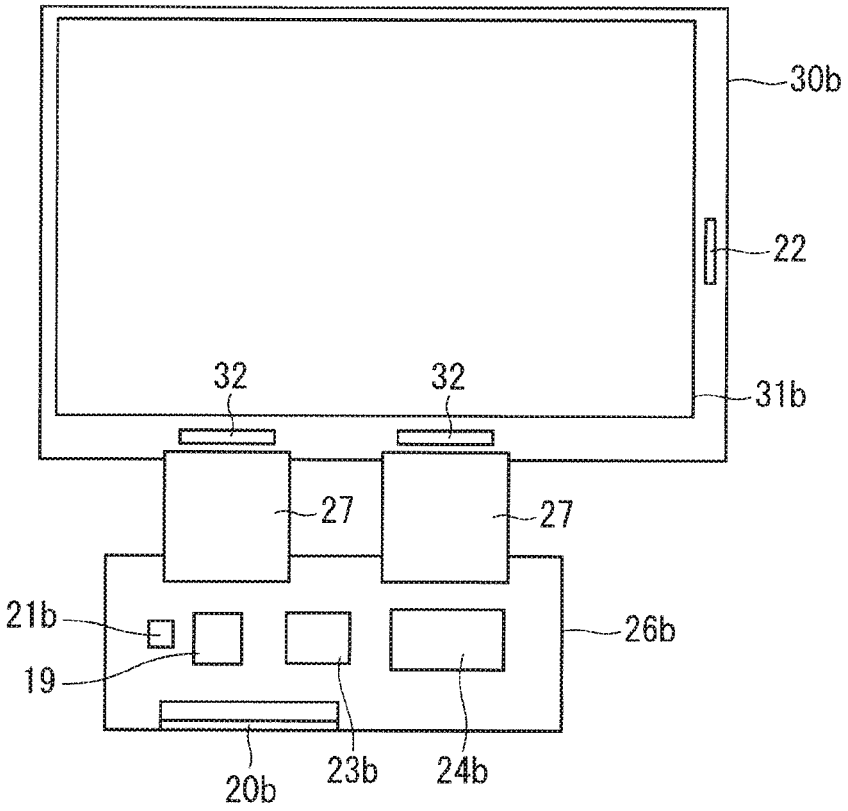
FIG. 12 shows another example of the configuration of the typical liquid crystal display apparatus.

As described above, the same common part has been used in various kinds of liquid crystal panels (see FIGS. 11 and 12). In FIGS. 11 and 12, interface connectors 20*a*, 20*b* may simply be referred to as an interface connector 20. EEPROMs 21*a*, 21*b* may simply be referred to as an EEPROM 21. Power supply circuits 23*a*, 23*b* may simply be referred to as a power supply circuit 23. Gradation-reference-voltage generating circuits 24*a*, 24*b* may simply be referred to as a gradation-reference-voltage generating circuit 24. Circuit boards 26*a*, 26*b* may simply be referred to as a circuit board 26. Liquid crystal panels 30*a*, 30*b* may simply be referred to as a liquid crystal panel 30. Pixel regions 31*a*, 31*b* may simply be referred to as a pixel region 31.

Figure 13:
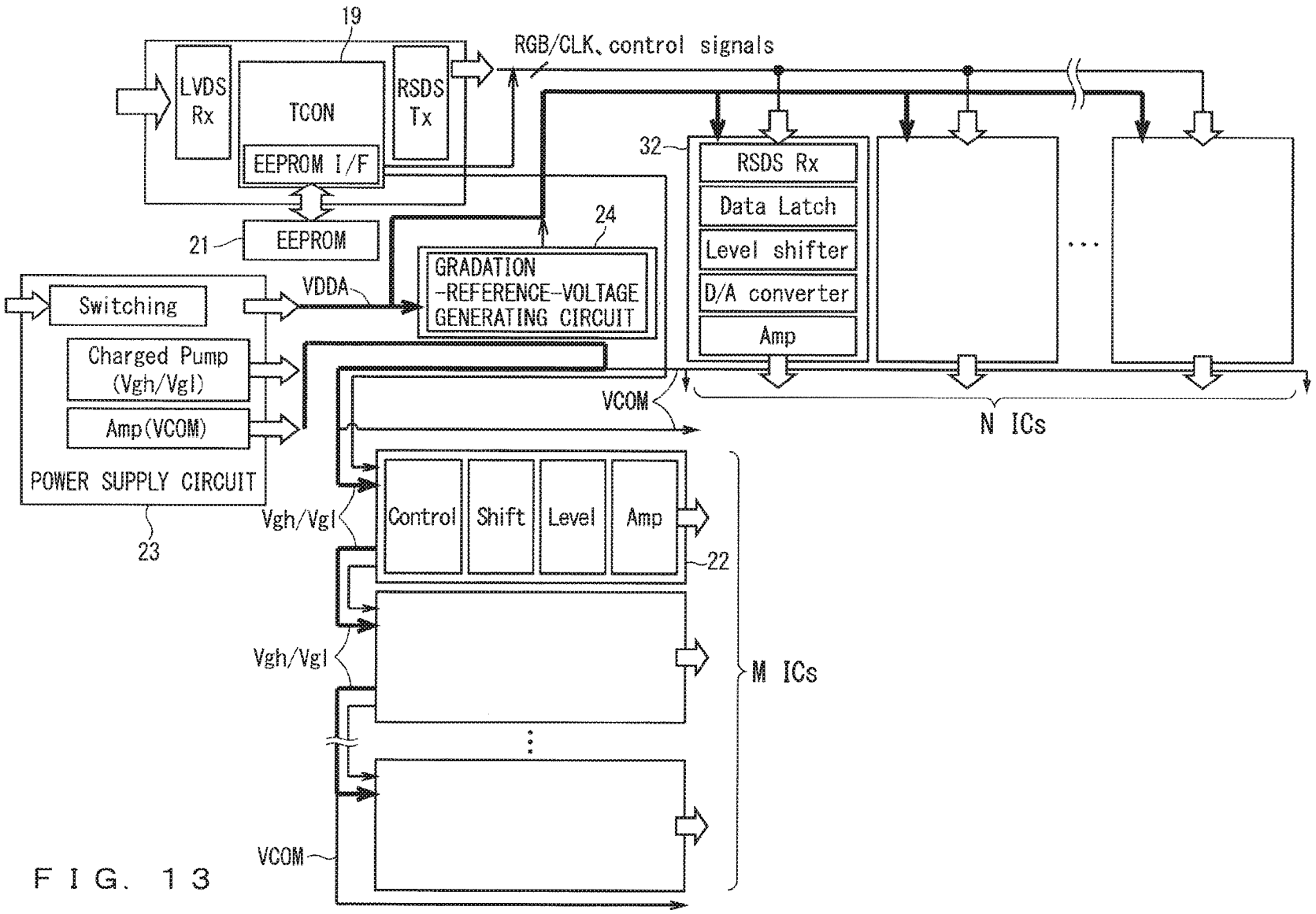
FIG. 13 is a block diagram showing an example of the configuration of the typical liquid crystal display apparatus.

As shown in FIG. 13, the typical liquid crystal display apparatus includes a timing controller (TCON) 19, an electrically erasable programmable read-only memory (EEPROM or may be referred to as E2PROM) 21 that stores setting data of the TCON 19, a source driver IC 32, a gate driver IC 22, a power supply circuit 23, and a gradation-reference-voltage generating circuit 24. In FIG. 13, reduced swing differential signaling (RSDS) Tx/Rx, such as mini-LVDS Tx/Rx, may be an interface that connects another TCON 19 to the source driver IC 32. Low voltage differential signaling (LVDS) Rx, such as transistor-transistor logic (TTL) and Embedded Display Port (eDP), may be an interface that connects the other system side to the TCON 19. The other system side is an external equipment side, which is not shown. The external equipment inputs image data and a synchronization signal to the liquid crystal display apparatus.

Figure 14:
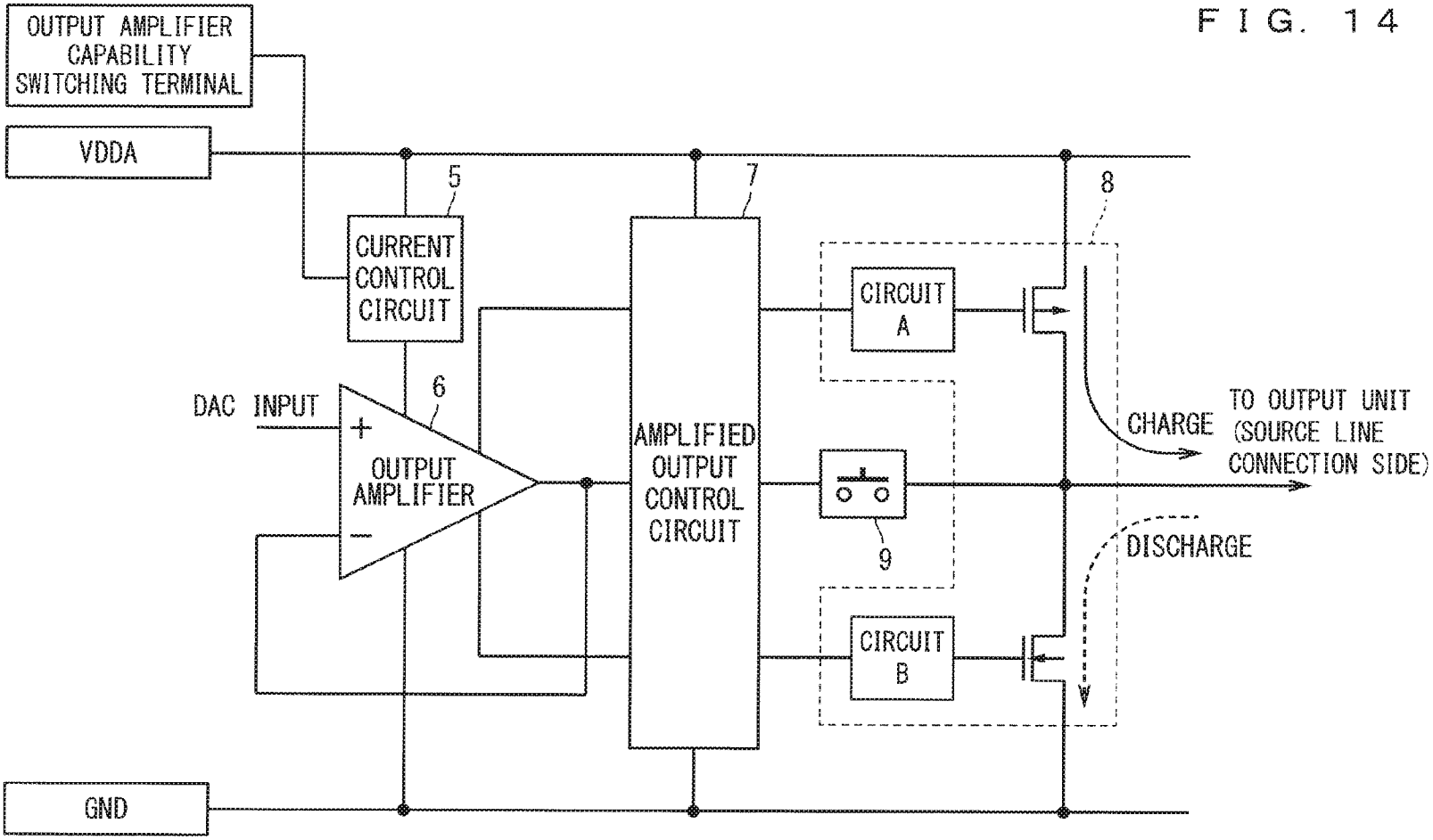
FIG. 14 shows an example of a configuration of a driver IC.

Some driver ICs capable of driving a liquid crystal panel under heavy load conditions include an assist circuit 8 (see FIG. 14). The assist circuit is a current source separated from an output amplifier 6 to support an output of the liquid crystal panel 30 to the pixel region 31. The assist circuit 8 includes a P-channel metal oxide semiconductor (PMOS) transistor, which is a switch on a power supply side, an N-channel metal oxide semiconductor (NMOS) transistor, which is a switch on a GND side, and various circuits (circuit A, circuit B) in which the PMOS transistor and the NMOS transistor do not turn ON simultaneously so as not to output a large current.

Figure 15:
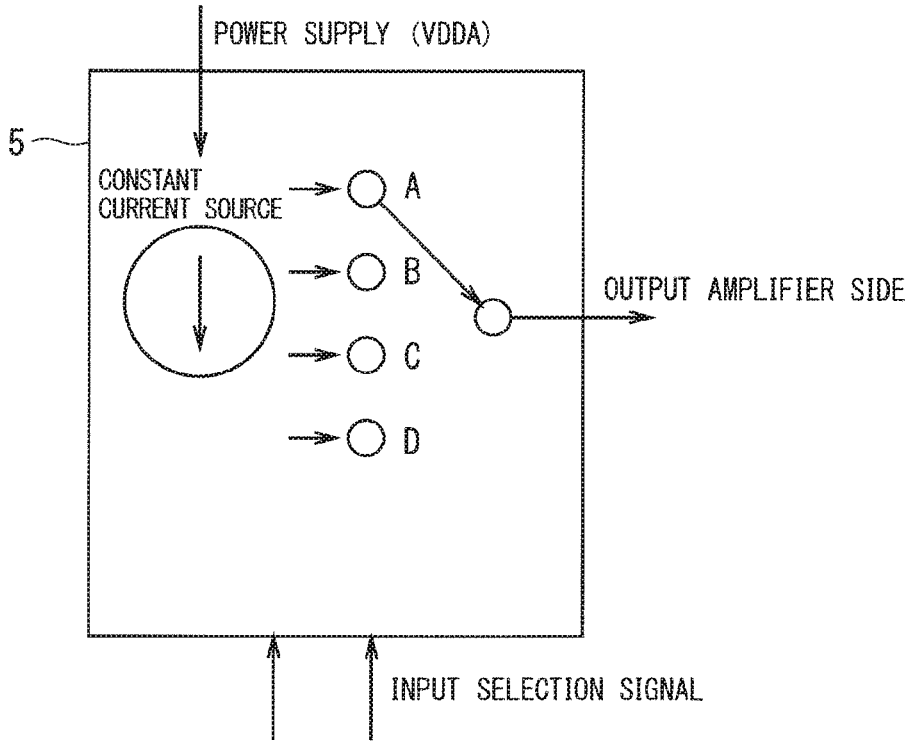
FIG. 15 shows an example of a configuration of a current control circuit.

When the driver IC capable of driving a liquid crystal panel under heavy load conditions is used to drive a liquid crystal panel under low load conditions, a current control circuit 5 is typically used to change an amount of current input to the output amplifier 6 based on a signal (input selection signal) input from the outside (see FIG. 15). In FIG. 15, the amount of current input to the output amplifier is assumed to be "A>B>C>D". The current control circuit 5 is used to suppress an increase in current consumption when the liquid crystal panel under the low load conditions is driven.

Figure 16:
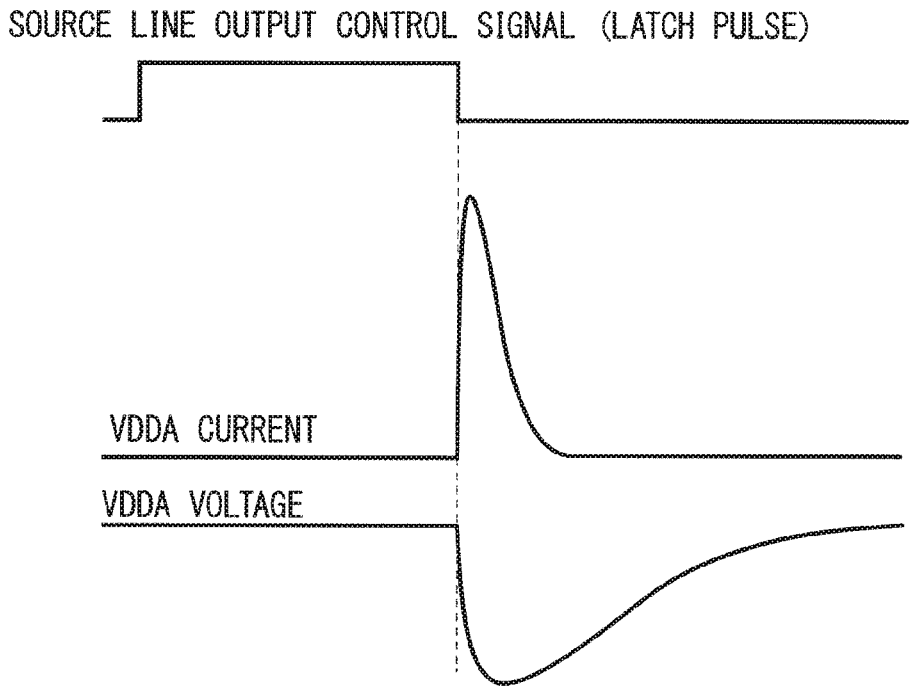
FIG. 16 shows an example of VDDA waveforms of an output amplifier.

However, one horizontal period of time, for example, is shortened due to the increase in resolution and the increasing number of output amplifiers installed in the driver IC with the recent increase in the number of output channels. This also leads to more strict timing settings of drive of liquid crystals. For example, as shown in FIG. 16, after a fall time of a latch pulse, which is a kind of control signals transmitted to the source driver IC 32, or after a time lag, the source driver IC performs a writing operation (or generally referred to as "charging") on source lines simultaneously or every block of output terminals at staggered starting time. To write the voltage on the source lines in one horizontal period and then in the next one horizontal period, the source lines need to be isolated once from the amplification side (Hi-Z state) with a switch 9 in FIG. 14 to change a voltage value. Upon the writing, VDDA current (current for an analog circuit) abruptly increases, causing VDDA voltage (voltage for an analog power supply) to temporarily decrease, but the VDDA current and the VDDA voltage are gradually restored. Such a change is widely called a load change that changes according a resolution, a size, or a structure of a liquid crystal panel. The increase in resolution shortens the one horizontal period of time, but a "H (High)" width of a period of the latch pulse needs to be provided for a certain period of time. For example, the "H" width of the latch pulse typically needs time of approximately 1 to 3 μsec for charge sharing functions of shorting out the entire output of the source driver ICs once into an intermediate potential and of writing voltage on the source lines. For no charge sharing functions, the "H" width still needs time of approximately up to 1 μsec. The increase in resolution and size of the panel typically tends to increase a capacity and resistive components of the source lines, thereby easily causing the situation that has insufficient time for the restoration of the load change. Thus, the increase in resolution requires enhancement of the power supply circuit 23. However, the load change cannot be completely eliminated, so that the level of the VDDA voltage changes more frequently.

Figure 17:
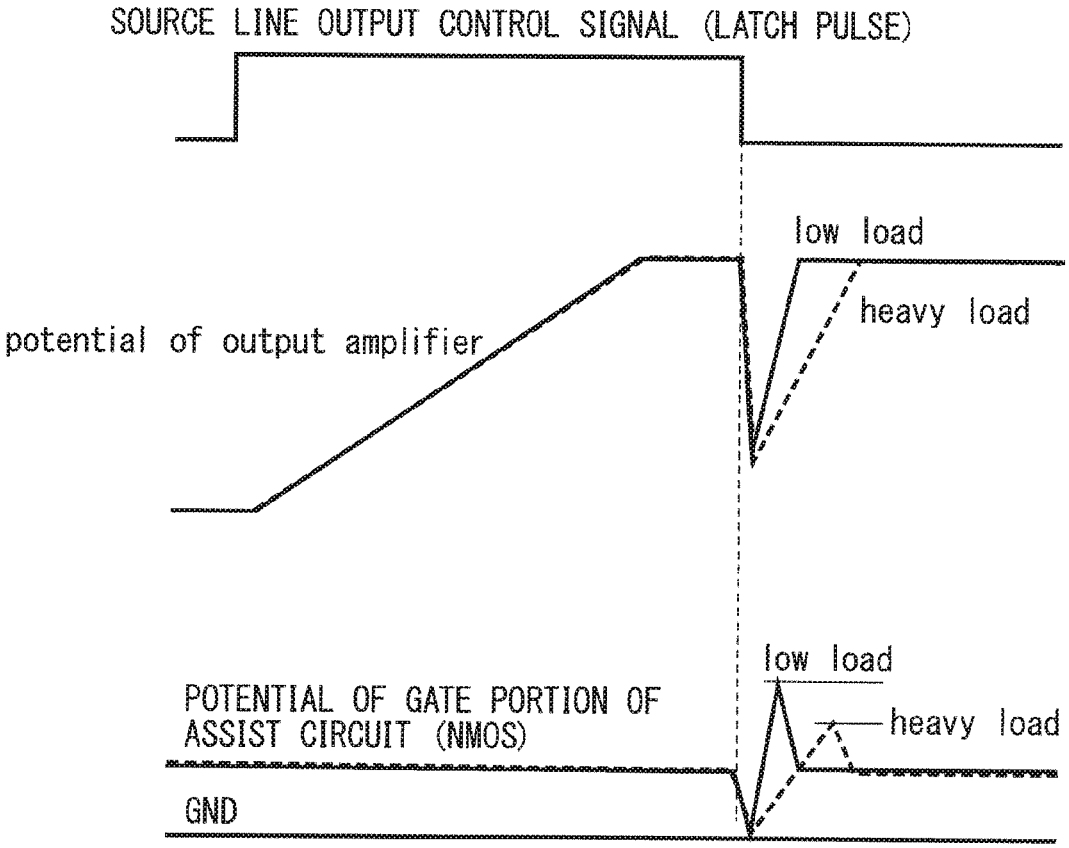
FIG. 17 shows an example of changes in a potential of the output amplifier and a potential of a gate portion of an NMOS transistor in an assist circuit at timing of writing operations of the source driver IC under a heavy load and a low load.

A potential of a gate portion of the MOOS transistor in the assist circuit 8, which has no problem in operating under originally assumed heavy load conditions, is affected depending on conditions that, for example, parasitic capacitance is formed in an amplified output control circuit 7. This causes the assist circuit 8 to turn ON simultaneously with the PMOS transistor in the ON state for charging, thereby generating the flow-through current (see FIG. 17). The generation of the flow-through current causes a malfunction such that the flow-through current vibrates the power supply and the GND (changes the potential of the power supply and the UND) and further increases, leading to a vicious cycle. The increase in inductor and resistive component of power supply lines supplied to the driver IC further increases the above-mentioned unstable operations, and thus the assist circuit 8 becomes more susceptible to a change in overall resistance value in the range of a flexible printed circuit (FPC) 27 (see FIGS. 11 and 12) to a driver input terminal (such as a VDDA terminal in FIG. 14). The increase in the flow-through current does not affect the display, so that whether the flow-through current is generated needs to be monitored with an ammeter used for the output of the VDDA in FIG. 3 or external power supply tines that input current and are connected to the power supply circuit 23, for example. Therefore, the generation of the flow-through current cannot be easily monitored according to the product conditions of the liquid crystal display apparatus, thereby making it difficult to determine whether the liquid crystal panel is under abnormal conditions.

The present invention solves the problems above and gives descriptions below in detail.

First Preferred Embodiment

Figure 1:
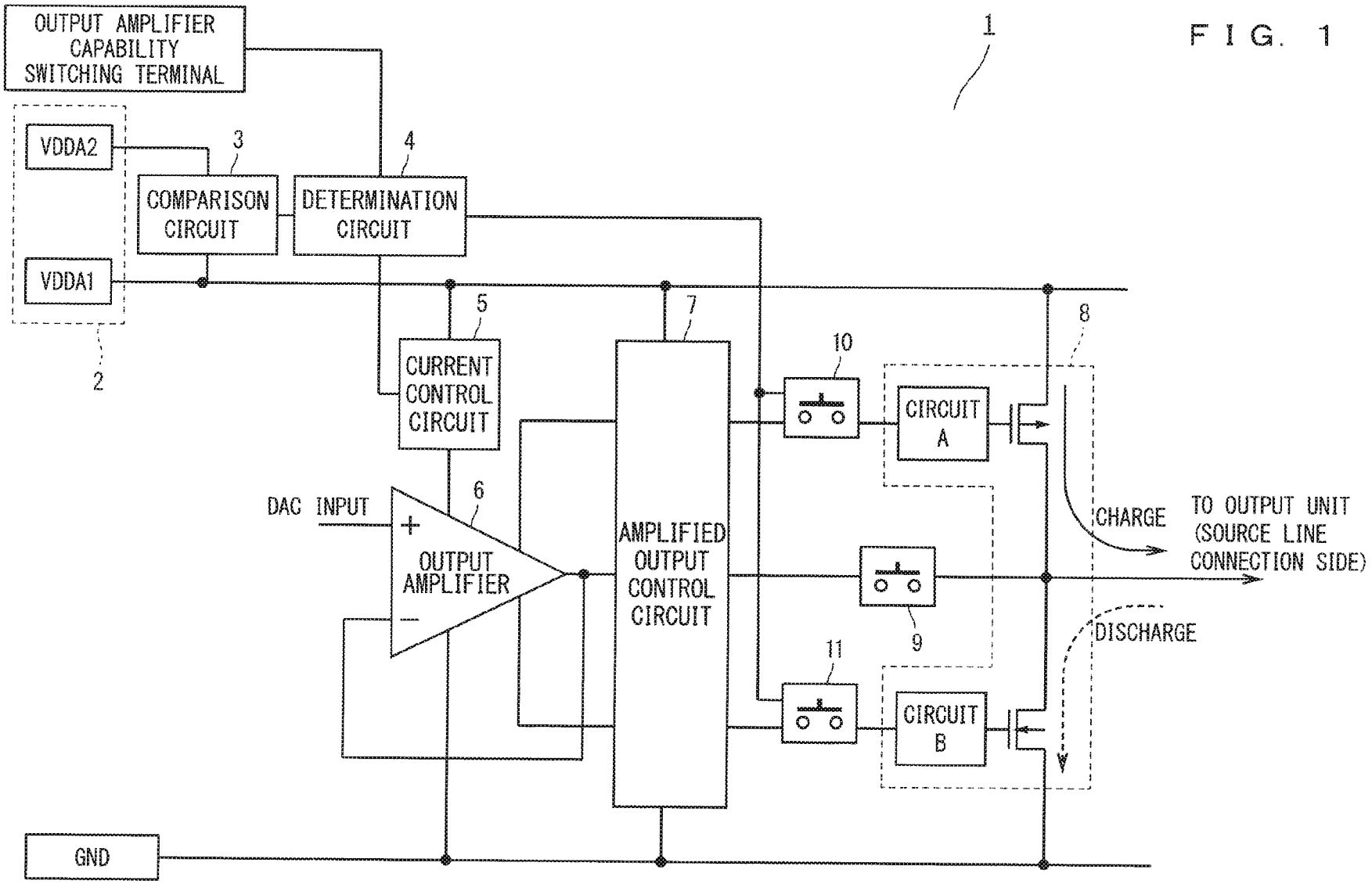
FIG. 1 shows an example of a configuration of a source driver IC in a first preferred embodiment according to the present invention.

FIG. 1 shows an example of a configuration of a source driver IC 1 in a first preferred embodiment according to the present invention. The source driver IC 1 replaces the source driver 32 shown in FIGS. 11 to 13.

As shown in FIG. 1, the source driver IC 1 includes a VVDA input terminal 2, a comparison circuit 3, a determination circuit 4, a control switch 10 (first control switch), and a control switch 11 (second control switch). The other configuration is the same as the configuration of the driver IC shown in FIG. 14 which will not be described here in detail.

Figure 2:
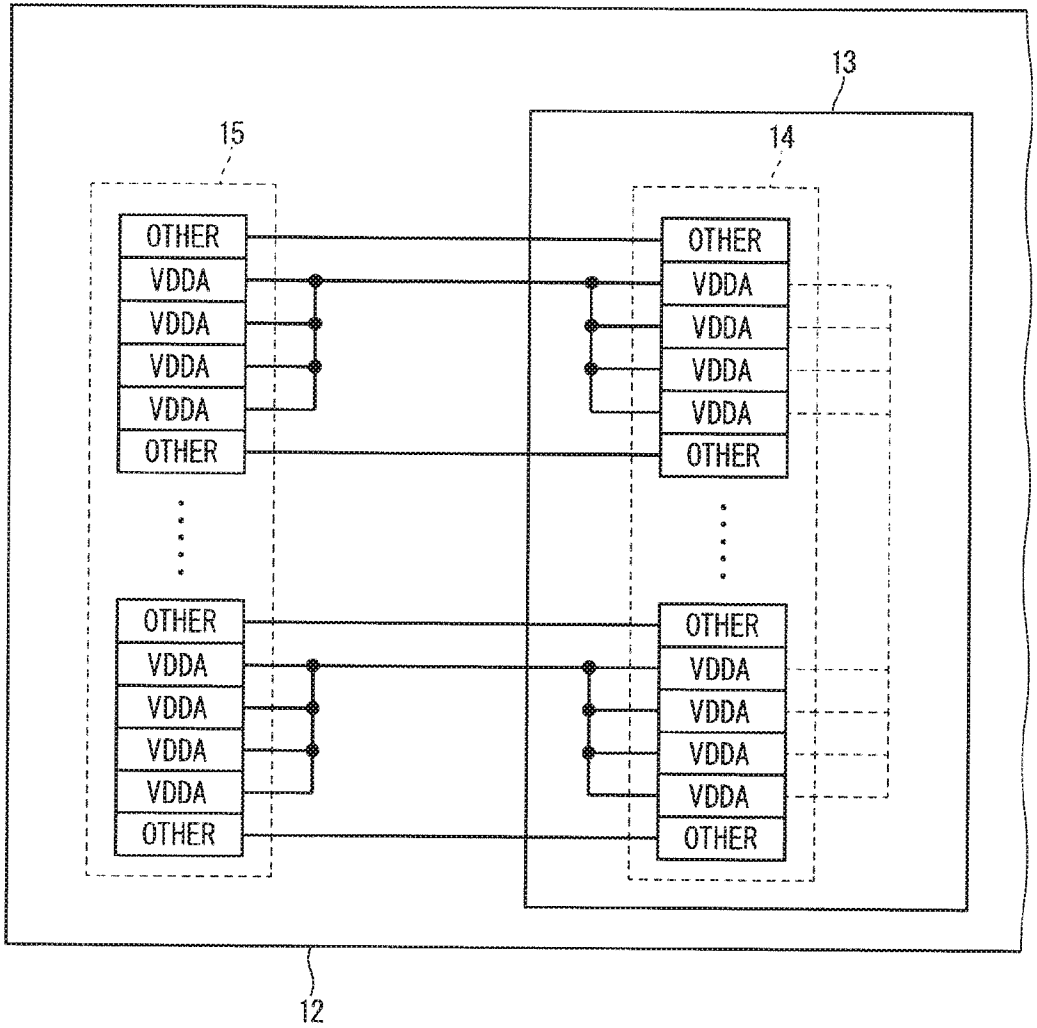
FIG. 2 shows an example of a connection of a typical VDDA.

The source driver IC includes the power supply for logic (VDDR) and the power supply for an analog circuit (VDDA). As shown in FIG. 2, the typical source driver IC 13 includes terminals at the same potential wired together. FIG. 2 shows an example in which VDDA connection terminals 15 at the same potential are wired together and connected to VDDA input terminals 14 of the source driver IC 13. The VDDA connection terminals 15 are located in a peripheral portion of a liquid crystal panel 12 and can be connected to terminals in the FPC 27. The source driver IC 13 may be the source driver IC 32 in FIG. 13. The liquid crystal panel 12 may be the liquid crystal panel 30 (see FIGS. 11 and 12).

Figure 3:
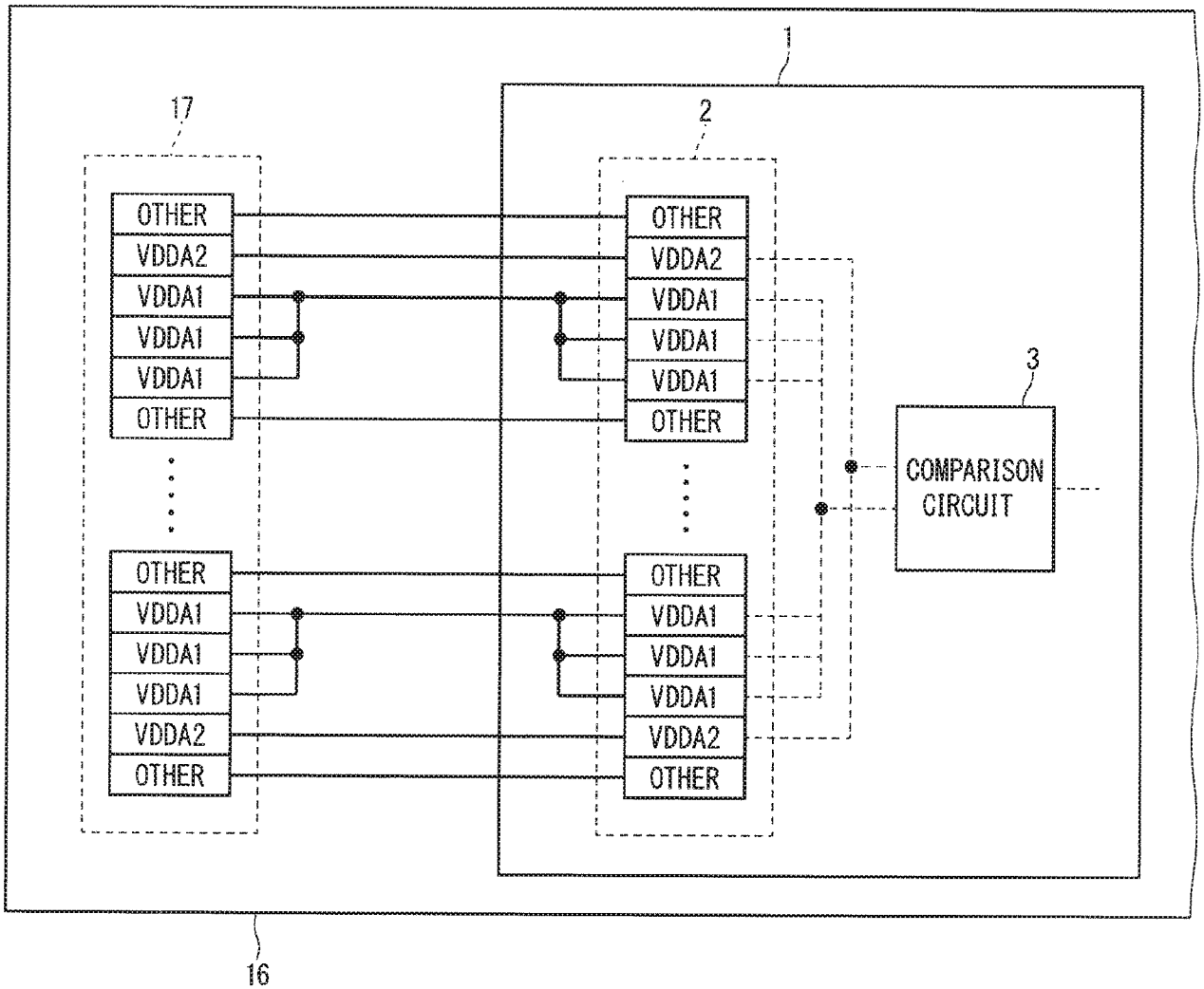
FIG. 3 shows an example of a connection of a VDDA in the first preferred embodiment according to the present invention.

In the first preferred embodiment, as shown in FIG. 3, the VDDA (analog power supply) input from the outside is physically divided into terminals of VDDA1 (first analog power supply) and terminals of VDDA2 (second analog power supply) in VDDA connection terminals 17 while terminals of VDDA1 are physically divided from terminals of VDDA2 also in VDDA input terminals 2 of the source driver IC 1. The terminals of VDDA1 and the terminals of VDDA2 in the VDDA input terminals 2 are each connected to the comparison circuit 3. The VDDA connection terminals 17 are located in a peripheral portion of a liquid crystal panel 16 and can be connected to the terminals of VDDA in the FPC 27. The liquid crystal panel 16 may be the liquid crystal panel 30 (see FIGS. 11 and 12).

Figure 4:
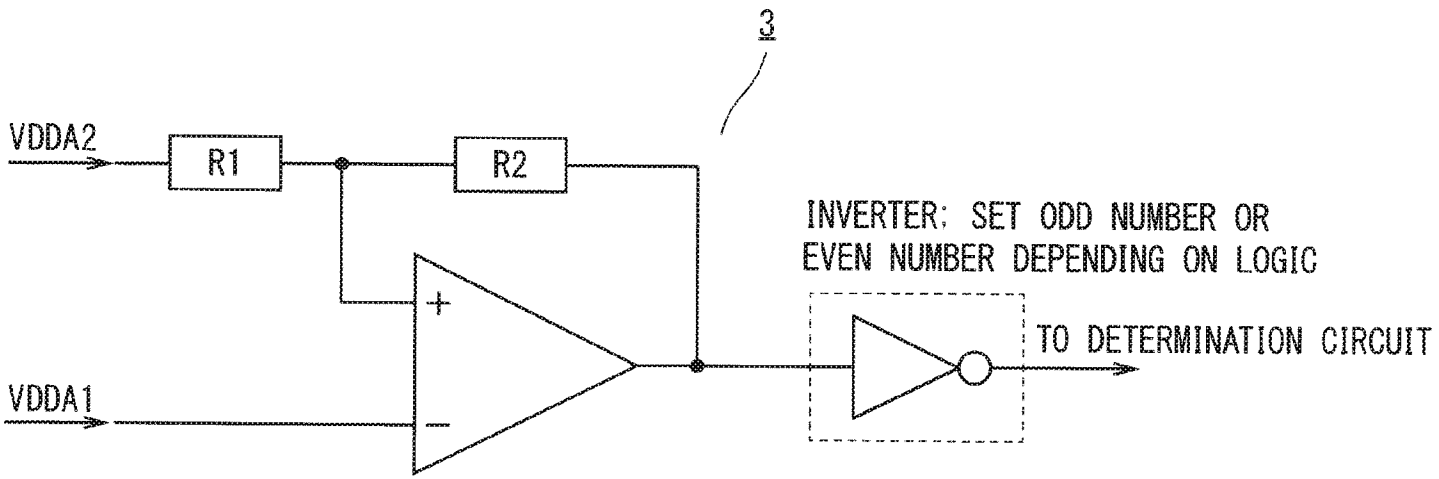
FIG. 4 shows an example of a comparison circuit in the first preferred embodiment according to the present invention.

The comparison circuit 3 includes a comparator shown in FIG. 4, for example. The comparison circuit 3 detects a potential difference between the potential of the VDDA1 and the potential of VDDA2, and converts the detected potential difference into binary logic to output the binary logic to the determination circuit 4.

The determination circuit 4 determines that it is an abnormal condition if the potential difference detected by the comparison circuit 3 is greater than or equal to a predetermined threshold value. For example, the determination circuit 4 determines that it is the abnormal condition if the binary logic input from the comparison circuit 3 is "H". The results detected by the determination circuit 4 are output to the current control circuit 5.

When receiving a signal (input selection signal) for indicating the abnormal condition from the determination circuit 4, the current control circuit 5 (see FIG. 15) switches the amount of current input to the output amplifier to low (for example, switches the amount of current from A to D). In other words, when the determination circuit 4 determines that it is the abnormal condition, the current control circuit 5 controls the amount of current so as to reduce the current output from the output amplifier 6 to the pixel region 31 (see FIGS. 11 and 12).

When the determination circuit 4 determines that it is the abnormal condition, the control switches 10, 11 receive the signal for indicating the abnormal condition and then control the assist circuit 8 to avoid abnormal operations of the assist circuit 8, that is to say, control the PMOS transistor and the NMOS transistor not to turn them ON simultaneously.

Figure 5:
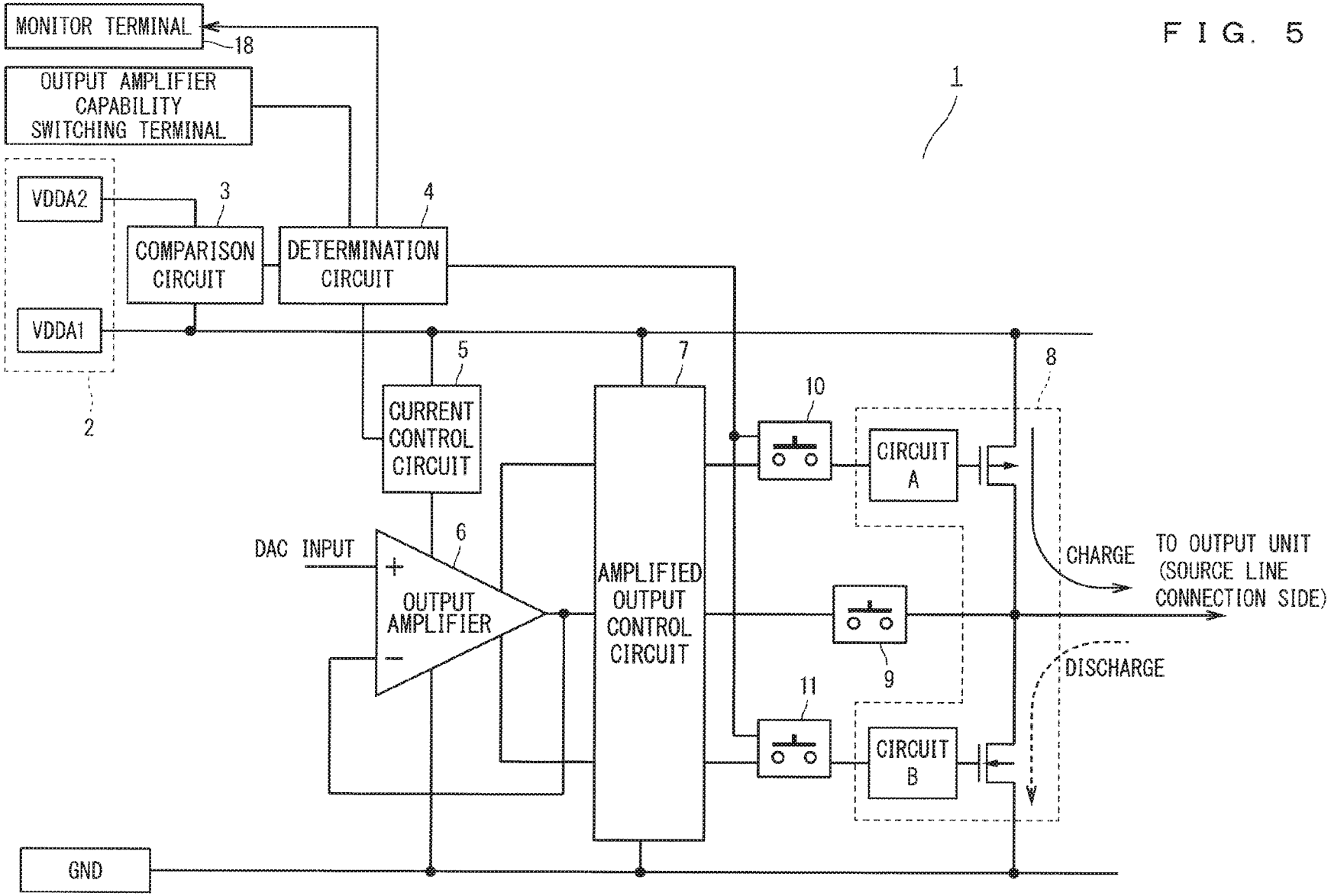
FIG. 5 shows another example of the configuration of the source driver IC in the first preferred embodiment according to the present invention.
Figure 6:
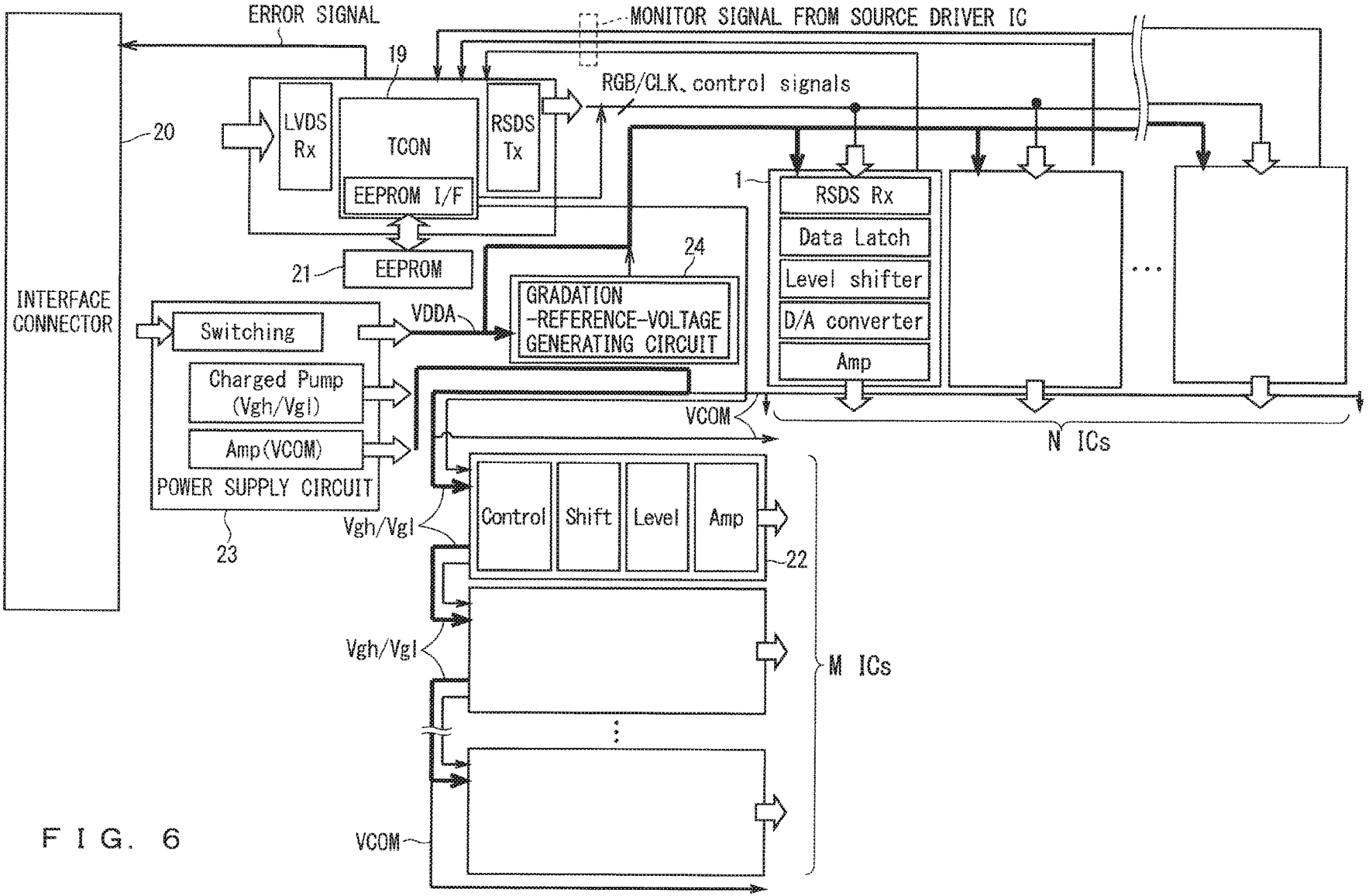
FIG. 6 is a block diagram showing an example of a configuration of a liquid crystal display apparatus in the first preferred embodiment according to the present invention.

The determination circuit 4 may output the signal for indicating the abnormal condition to a system side (not shown) when determining that it is the abnormal condition. For example, the source driver IC 1 includes a monitor terminal 18 as shown in FIG. 5, and the signal (monitor signal) for indicating the abnormal condition may be output to the TCON 19 via the monitor terminal 18 (see FIG. 6). FIG. 6 shows that the TCON 19 can output an error signal to the system side via the interface connector 20 after the TCON 19 recognizes the monitor signal input from the source driver IC 1.

Figure 7:
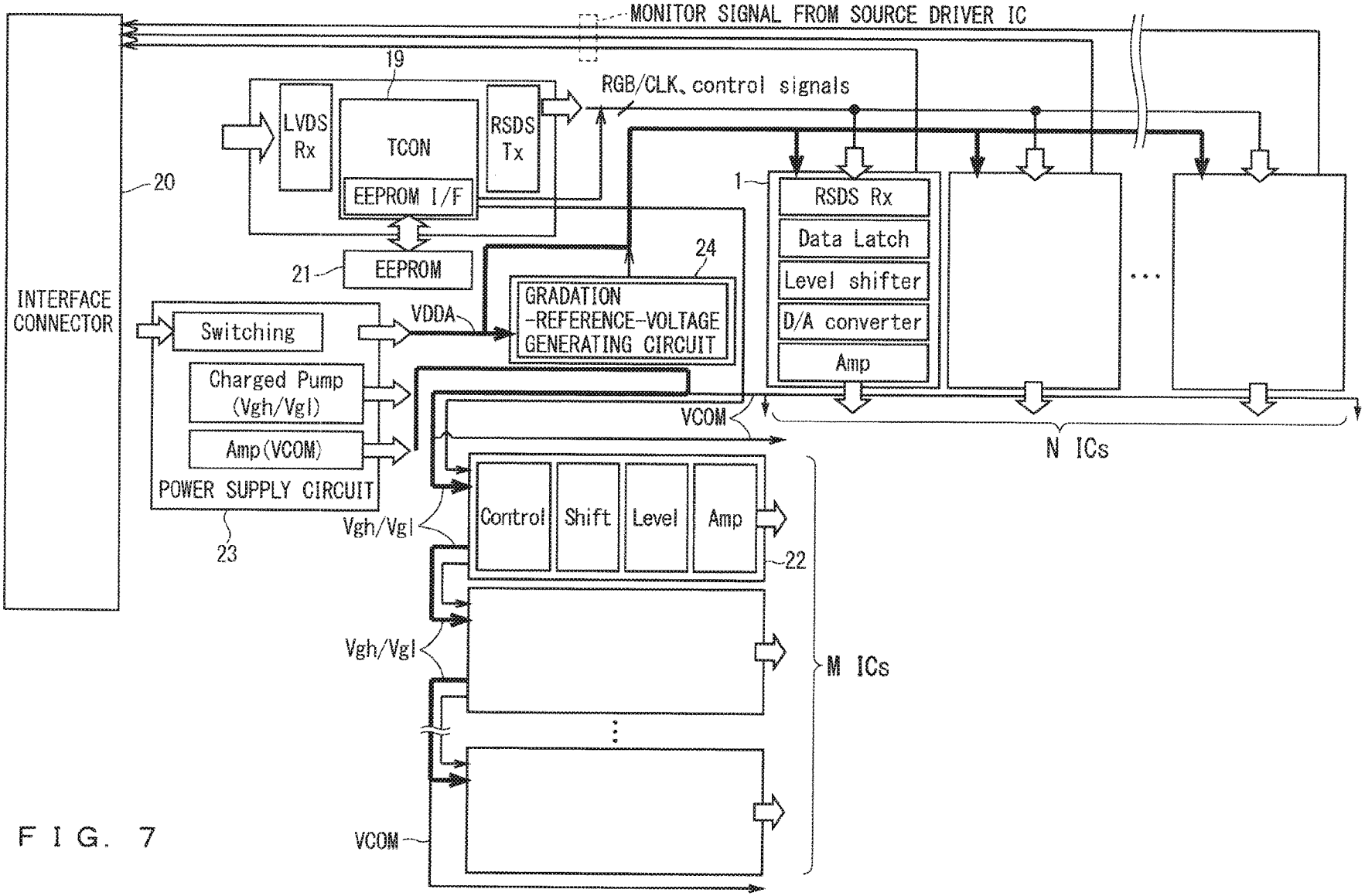
FIG. 7 is a block diagram showing another example of the configuration of the liquid crystal display apparatus in the first preferred embodiment according to the present invention.

For another method for outputting the signal for indicating the abnormal condition to the system side, the signal (monitor signal) for indicating the abnormal condition may be directly output to the interface connector 20 via the monitor terminal 18, as shown in FIG. 7. In this case, the system side can directly monitor the abnormal condition.

As described above, the first preferred embodiment can suppress the flow-through current generated in the assist circuit 8 under the low load conditions. This can reduce the value of VDDA current, thereby reducing overall power consumption of the liquid crystal display apparatus. Further, whether the liquid crystal panel is under the abnormal condition can be easily monitored. Although the system construction in consideration of ISO26262, which is the functional safety standard for automobiles, has been questioned, the first preferred embodiment can monitor abnormal conditions (such as a break in wire). The system side can monitor the abnormal conditions, and enables a display itself even if the liquid crystal panel is under the abnormal condition, allowing the display to notify the user of the condition of the liquid crystal panel. If the liquid crystal panel is under the abnormal condition, the user can also be urged to handle the abnormal condition.

Second Preferred Embodiment

Figure 8:
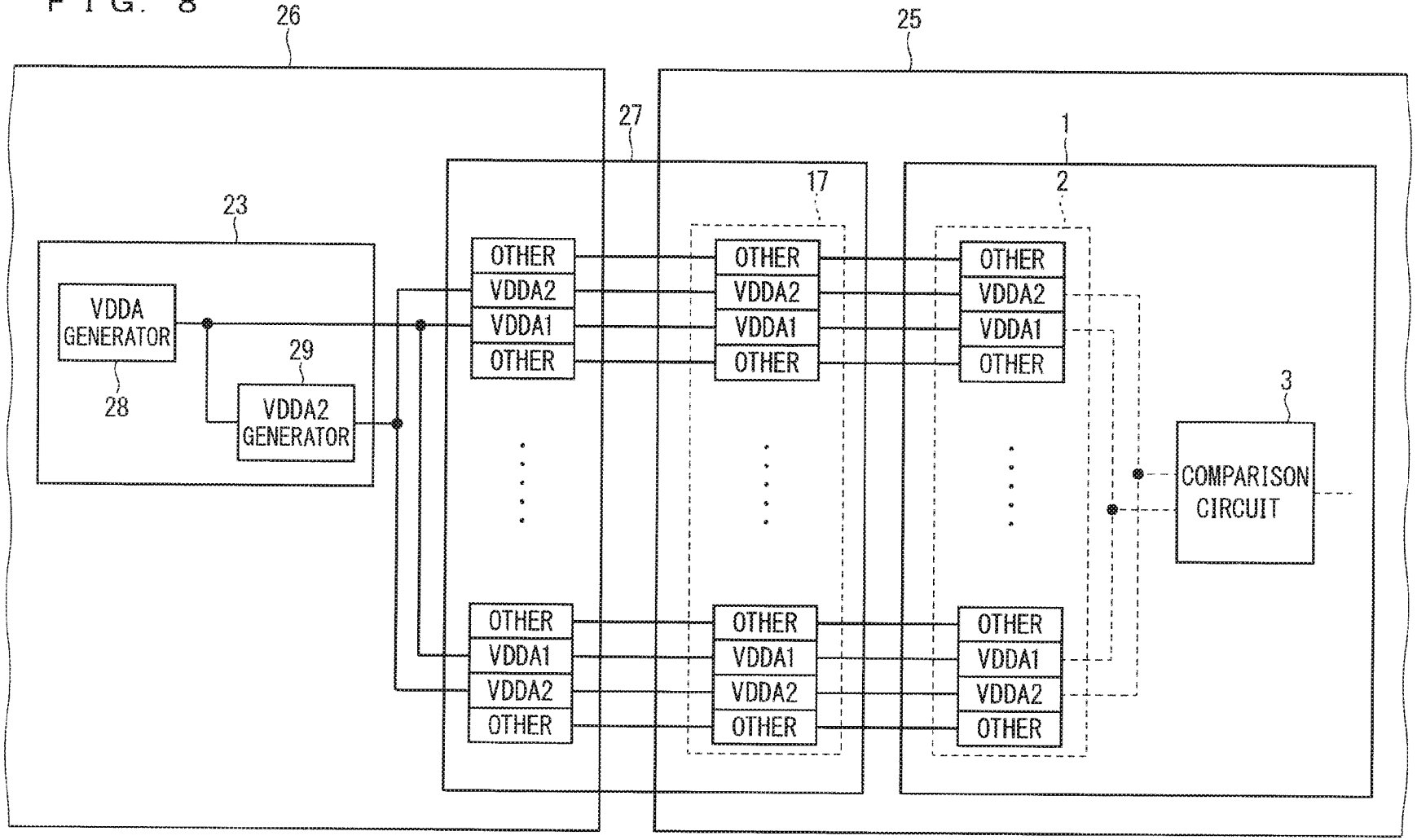
FIG. 8 shows an example of a connection of a VDDA in a second preferred embodiment according to the present invention.

The first preferred embodiment gives the descriptions about the connection between both of the VDDA1 and VDDA2 as shown in FIG. 3 and the VDDA output from the power supply circuit 23. As shown in FIG. 8, a second preferred embodiment according to the present invention includes a VDDA2 generator 29 that is a stabilization circuit such as a regulator circuit. Terminals, such as VDDD terminals, GND terminals, setting terminals, and dummy terminals that have no connection, other than the VDDA1 and the VDDA2 are described as "Other" and omitted. The configuration and the operations are the same as those in the first preferred embodiment, which will not be described here in detail.

As shown in FIG. 8, the VDDA output from a VDDA generator 28 of the power supply circuit 23 is divided into the VDDA1 and the VDDA2. The power supply circuit 23 includes the VDDA2 generator 29, which is the stabilization circuit for the VDDA2. The VDDA2 generated by the VDDA2 generator 29 is input to the terminals of the VDDA2 in the VDDA input terminals 2 of the source driver IC 1 via the FPC 27. In this case, the VDDA2 is completely divided from the VDDA1 supplied as the power supply (current source) of the output amplifier 6.

As described above, the second preferred embodiment can reduce the load change in the VDDA2 as shown in FIG. 16. This can make it easy to compare the VDDA2 with the VDDA1 affected by the load change, and thus the unstable operations of the assist circuit 8 can be more easily detected.

Third Preferred Embodiment

Figure 9:
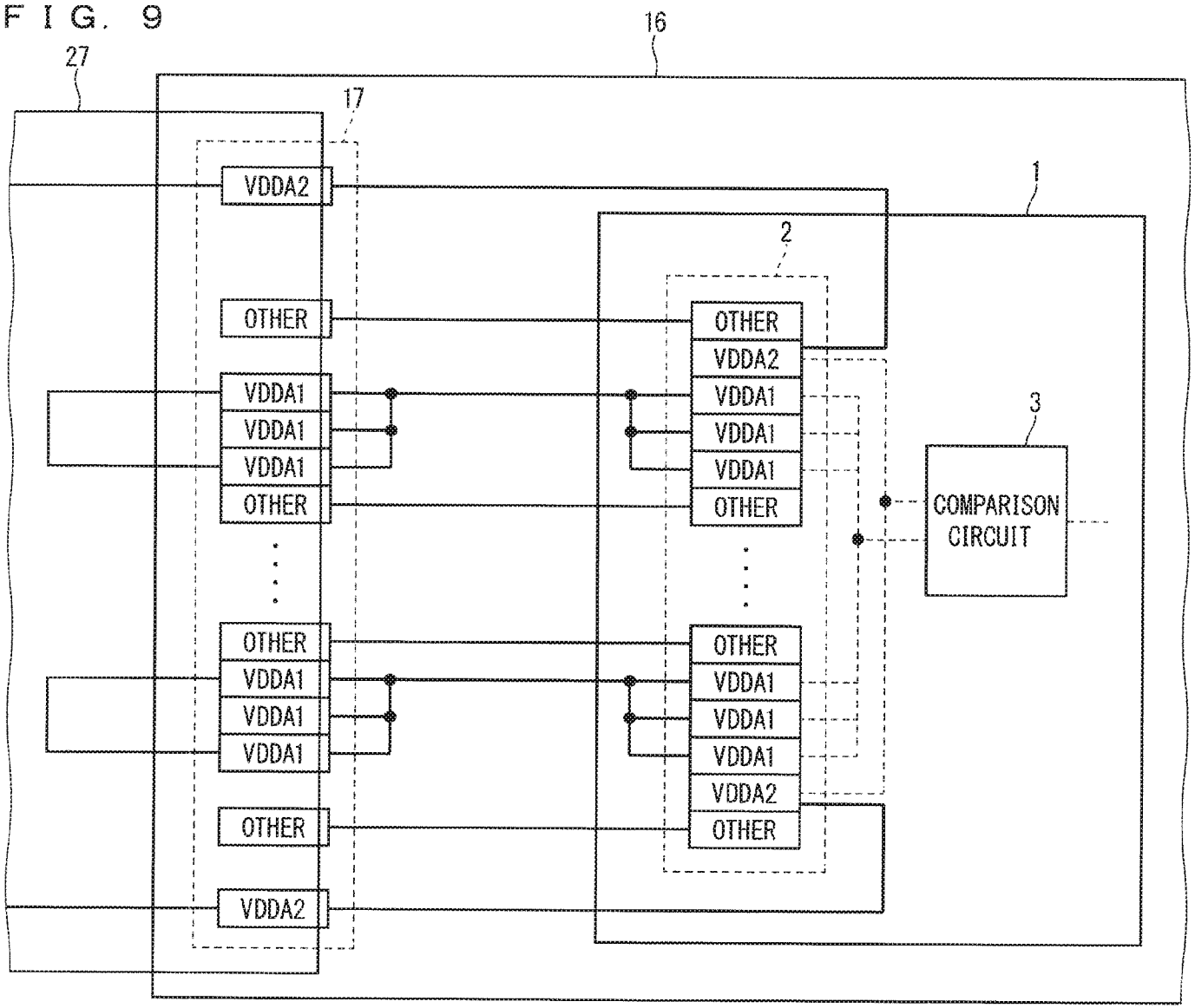
FIG. 9 shows an example of a connection of a VDDA in a third preferred embodiment according to the present invention.

As shown in FIG. 9, a third preferred embodiment according to the present invention includes the terminals of the VDDA2 in the VDDA connection terminals 17 in the liquid crystal panel 16 located in a position corresponding to an end side-portion of the FPC 27. The other configuration and operations are the same as those in the first preferred embodiment or the second preferred embodiment, which will not be described here in detail.

The application of stress such as vibrations or impacts to the liquid crystal display apparatus shown in FIGS. 11 and 12 easily causes stress on the end side-portion of the FPC 27, and thus a break is more likely to occur in wires of the end portion (especially for the end side-portion) of the FPC 27. As shown in FIG. 9, when the terminals of the VDDA2 (second connection terminals) in the VDDA connection terminals 17 in the liquid crystal panel 16 are located in the position corresponding to the end side-portion of the FPC 27, the application of stress to the liquid crystal display apparatus causes a break in the wires connected to the terminals of the VDDA2 located in the end side-portion before a break occurs in the wires connected to terminals of the VDDA1 (first connection terminals) located in the middle of the end portion of the FPC 27. The broken wires have a resistance value greatly increased. A sum of a resistance of wiring in the liquid crystal panel 16 and a resistance of an anisotropic conductive film (ACT) often results in a resistance value of normally approximately lower than or equal to 10Ω in the power supply and the GND lines. The copper wiring portions on the FPC and the circuit board 26 have a resistance much lower than 1Ω, so that the resistance is negligible in comparison with variations in the resistance of wiring in the liquid crystal panel 30. A completely broken wire has a resistance value of MΩ order while an almost broken wire has a resistance value between the resistance value in the normal condition and the resistance value in the case where the wire is broken.

As described above, in the third preferred embodiment, the comparison circuit 3 can detect the increase in the resistance value of the wires of the VDDA2 that are broken before the wires of the VDDA1. The determination circuit 4 determines whether it is the abnormal condition based on the results detected by the comparison circuit 3 and outputs the determination results to the system side, allowing the system side to monitor breaks in the VDDA2.

In addition, according to the present invention, the above preferred embodiments can be arbitrarily combined, or each preferred embodiment cart be appropriately varied or omitted within the scope of the invention. Another embodiment may include part of blocks of a circuit located in blocks of other components. For example, the portion of the RSDS Tx/Rx in FIGS. 6 and 7 is eliminated in the case of a driver IC with a built-in TCON, which is the source driver IC including the TCON 19 therein. Alternatively, another embodiment may include the power supply circuit 23 and the gradation-reference-voltage generating circuit 24 that are integrated with each other, or may include part of the power supply circuit 23 or the gradation-reference-voltage generating circuit 24 as the source driver IC 1 or as the gate driver IC 22.

While the invention has been shown and described in detail, the foregoing description is in all aspects illustrative and not restrictive. It is therefore understood that numerous modifications and variations can be devised without departing from the scope of the invention.

What is claimed is:

1. A drive device that is located in a liquid crystal panel and drives a pixel region of said liquid crystal panel, comprising:

a comparison circuit that detects a potential difference between a potential of a first analog power supply and a potential of a second analog power supply, an analog power supply input from the outside being divided into said first analog power supply and said second analog power supply, each of said first analog power supply and said second analog power supply is supplied to the comparison circuit;

a determination circuit that determines that it is an abnormal condition when said potential difference detected by said comparison circuit is greater than or equal to a predetermined threshold value, and controls said drive device to reduce a current output to said pixel region of said liquid crystal panel;

an auxiliary circuit that includes a PMOS transistor and an NMOS transistor and supports an output to said pixel region;

a first control switch that controls an operation of said PMOS transistor; and a second control switch that controls an operation of said NMOS transistor, wherein when said determination circuit determines that it is said abnormal condition, said first control switch and said second control switch respectively control said PMOS transistor and said NMOS transistor so as not to turn them ON simultaneously.

2. The drive device according to claim 1, further comprising:

an output amplifier; and a current control circuit that controls an amount of current output from said output amplifier to said pixel region, wherein said current control circuit controls said amount of current so as to reduce the current output from said output amplifier when said determination circuit determines that it is said abnormal condition.

3. The drive device according to claim 1, wherein said determination circuit outputs a signal for indicating said abnormal condition to the outside when determining that it is said abnormal condition.

4. A liquid crystal display apparatus, comprising the drive device according to claim 1.

5. The liquid crystal display apparatus according to claim 4, wherein said first analog power supply and said second analog power supply are supplied to said drive device via a flexible printed circuit (FPC), said liquid crystal panel includes a first connection terminal of said first analog power supply that can be connected to said FPC and a second connection terminal of said second analog power supply that can be connected to said FPC, and one of said first connection terminal and said second connection terminal is located in a position corresponding to an end side-portion of said FPC.

6. The liquid crystal display apparatus according to claim 5, wherein one of said first analog power supply and said second analog power supply is supplied to said drive device via a stabilization circuit.

7. The drive device according to claim 1, wherein, when said determination circuit determines that it is said abnormal condition, each of said first control switch and said second control switch receives an abnormal condition determination signal from said determination circuit, and said first control switch and said second control switch control said PMOS transistor and said NMOS transistor, respectively, so as not to turn them ON simultaneously and to reduce the current output to said pixel region of said liquid crystal panel.

* * * * *